United States Patent [19]

Yamane

[11] Patent Number: 4,852,207

[45] Date of Patent: Aug. 1, 1989

[54] MOP SQUEEZER

[76] Inventor: Izumi Yamane, 3715-30, Yana Kisarazu-shi, Chiba-ken, Japan

[21] Appl. No.: 157,633

[22] Filed: Feb. 18, 1988

[51] Int. Cl.[4] ..... A47L 13/60

[52] U.S. Cl. ..... 15/262

[58] Field of Search ..... 15/260, 261, 262, 263, 15/264, 119 R, 119 A; 4/654; 220/85 R, 90

[56] References Cited

U.S. PATENT DOCUMENTS 1,922,981 8/1933 Robertson ..... 15/261 X

*Primary Examiner*—Peter Feldman

*Attorney, Agent, or Firm*—Frishauf, Holtz, Goodman & Woodward

[57] ABSTRACT

The mop squeezer of the invention provides an efficient means to squeeze a rinsed mop yarns to give a water content and distribution thereof most suitable in respect of the working efficiency of mopping of large building floors. The mop squeezer comprises a rotatable movable roller supported - by a pair of hand lever-operated swingable arms and an approximately cylindrical squeezer plate facing the movable roller. Characteristically, the distance from the surface of the squeezer plate to the shaft supporting the swingable arms is not uniform but smallest at the half height or below of the squeezer plate increasing downwardly and upwardly to be 105% to 140% of the smallest distance at the upper end of the squeezing plate.

1 Claim, 4 Drawing Sheets

MOP SQUEEZER

BACKGROUND OF THE INVENTION

The present invention relates to a mop squeezer or, more particularly, to an instrument for squeezing water-soaked absorbent yarns of a mop, which is easy to handle and capable of giving the squeezed mop yarns a water content most suitable for floor mopping in respect of the working efficiency.

Apart from the traditional cleaning works as a part of housekeeping, cleaning works of large buildings are usually undertaken more and more by specialized cleaning workers so that the efficiency of cleaning works considerably influences the overall costs for building maintenance. Among the various types of cleaning works of buildings, e.g., sweeping, dusting, window-pane polishing, etc., floor mopping has a very important weight so that improvement is eagerly desired in the working efficiency of floor mopping by those pertaining to the business of building maintenance.

When the floor mopping is performed with a mop having absorbent yarns wet with water, one of the factors influencing the working efficiency of floor mopping is of course in the step of squeezing of water-soaked absorbent yarns of mops and rapidness in the squeezing is essential. Besides, the working efficiency of floor mopping is greatly influenced by the water content of the mop yarns after squeezing. When the mop yarns are squeezed up too extensively to retain little water, for example, the mopping work on a floor cannot be continued before long because of the loss of lubrication between the floor and the mop yarns with a decreased water content so that the procedure of washing with water and squeezing thereof must be repeated frequently to greatly decrease the working efficiency of mopping. When the water content of the mop yarns after squeezing is too large, on the other hand, the mopping work with such a mop may result only in flooding of water over the floor and the cleaning effect inherent in mopping to wipe out and absorb the filth on the floor with the fibers of mop yarns cannot be exhibited. Thus, it is apparent that the working efficiency of floor mopping is greatly influenced by the water content of the mop yarns after squeezing so that it is eagerly desired by those having a specialized business of building maintenance to develop an efficient and convenient means by which the water content of mop yarns can be optimized easily and reproducibly.

In this regard, several types of mop squeezers have been proposed and some of them are practically used in the business of building maintenance. FIG. 1 of the accompanying drawing illustrates a perspective view of such a mop squeezer having a pair of rollers 31 and 32, of which the roller 32 is pivotally supported above an upwardly opening box 33 and the other roller 31 is movable by means of a foot pedal 34 through a link 35 to make a variable roll gap with the fixed roller 32. The roll gap between the rollers 31, 32 is the largest when the foot pedal 34 is released and the movable roller 31 is pressed against the fixed roller 32 when the foot pedal 34 is fully pressed down by foot. Thus, the mop yarns 36 are hung down between the rollers 31 and 32 making the largest roll gap therebetween with the foot pedal 34 released and then the foot pedal 34 is pressed down appropriately by foot so that the mop yarns 36 are pinched between the rollers 31, 32. In this pinched state, the mop yarns 36 are forcibly pulled up by hands holding the rod 37 of the mop so that the water soaking the mop yarns 36 is squeezed out and falls into the box 33 to make a water pool therein. A problem in the mop squeezer of this type is that the degree of squeezing or the water content of the mop yarns 36 after squeezing is totally dependent on the strength of force by which the foot pedal 34 is pressed down. When the force on the foot pedal 34 is too strong with the full body weight of the operator applied thereon, for example, the mop yarns 36 are pinched so tightly between the rollers 31, 32 that the mop rod 37 can hardly be pulled up or the water content in the squeezed mop yarns 36 is too small to ensure a good efficiency of the mopping work with the mop. When the force on the foot pedal 34 is too small, on the other hand, the mop yarns 36 are pinched between the rollers 31, 32 so loosely that the mop yarns 36 after squeezing may contain an excessively large volume of water and the cleaning efficiency with such a mop is disadvantageously low with mere flooding of water over the floor as is mentioned above.

Japanese Utility Model Publication 52-347 discloses a mop squeezer of another type in which a single freely rotatable roller is held on the ends of a pair of swingable arms fixed to a shaft pivotally supported in the upper part of an upwardly opening box like the box 33 in FIG. 1 and rotatable by means of a hand lever while a squeezer plate in a curved configuration to make a partial surface of a cylinder coaxial with the shaft supporting the swingable arms at such a position in the box that the gap between the surface of the roller and the squeezer plate is uniform when the roller is moved by the swinging motion of the swingable arms by means of the hand lever. The mop squeezers of this type, however, are not widely used in practice presumably due to several problems. For example, the mop yarns squeezed in this mop squeezer form undulation and the distribution of the water content throughout the mop yarns is not uniform to be higher in the free end portions of the yarns than in the root portions so that the working efficiency of mopping therewith cannot be high enough.

SUMMARY OF THE INVENTION

The present invention accordingly has an object to provide a mop squeezer with which mop squeezing works can be done very efficiently so as to give the squeezed mop yarns a water content most suitable for the mopping work.

Thus, the present invention provides an improvement, in a mop squeezer comprising a freely rotatable movable roller held at the ends of a pair of swingable arms fixed to a horizontal shaft pivotally supported in the upper part of an upwardly opening box and rotatable by means of a hand lever fixed to the shaft and a curved squeezer plate, the surface thereof being formed by the movement of a generating line in parallel with the shaft, fixed inside the box to face the movable roller, that the distance between the surface of the squeezer plate and the shaft is smallest at the half length or below along the curved surface of the squeezer plate and the distances between the upper end of the squeezer plate and the shaft and between the lower end of the squeezer plate and the shaft are in the range from 105% to 140% and in the range from 100% to 110% respectively, based on the smallest distance between the squeezer plate and the shaft.

A further improvement can be obtained by providing the squeezer plate with a plurality of drain perforations through which the water squeezed out of the mop yarns between the movable roller and the squeezer plate falls down to the bottom of the box.

A still further improvement can be obtained by providing a spring means inside each of the swingable arms which exerts a thrusting force to the movable roller whereby the movable roller is pressed against the squeezer plate.

DETAILED DESCRIPTION OF THE PREFERRED EMBODIMENTS

The most characteristic improvement in the mop squeezer proposed in this invention consists in the non-uniform distance between the shaft supporting the swingable arms and the surface of the smoothly curved squeezer plate on which the mop yarns are put and squeezed by the movement of the movable roller at the ends of the swingable arms. Namely, the distance is smallest at the half height or below of the squeezer plate and largest at the upper end thereof. By virtue of this unique design of the curvature of the squeezer plate, the mop yarns are tightly squeezed in the free end portions thereof and loosely squeezed in the root portions leaving a larger volume of water than in the free end portions. Such a distribution of the water content in the mop yarns advantageously enhances the working efficiency of mopping because, as the water contained in the free end portions of the mop yarns is lost by transfer to the mopped floor, the water contained in the root portions of the mop yarns moves toward the free end portions to facilitate further continued mopping works so that the mop yarns can be less frequently rinsed and squeezed.

In the following, the improvement in a mop squeezer proposed by the invention is described in detail with reference to the accompanying drawing.

Figure 1:
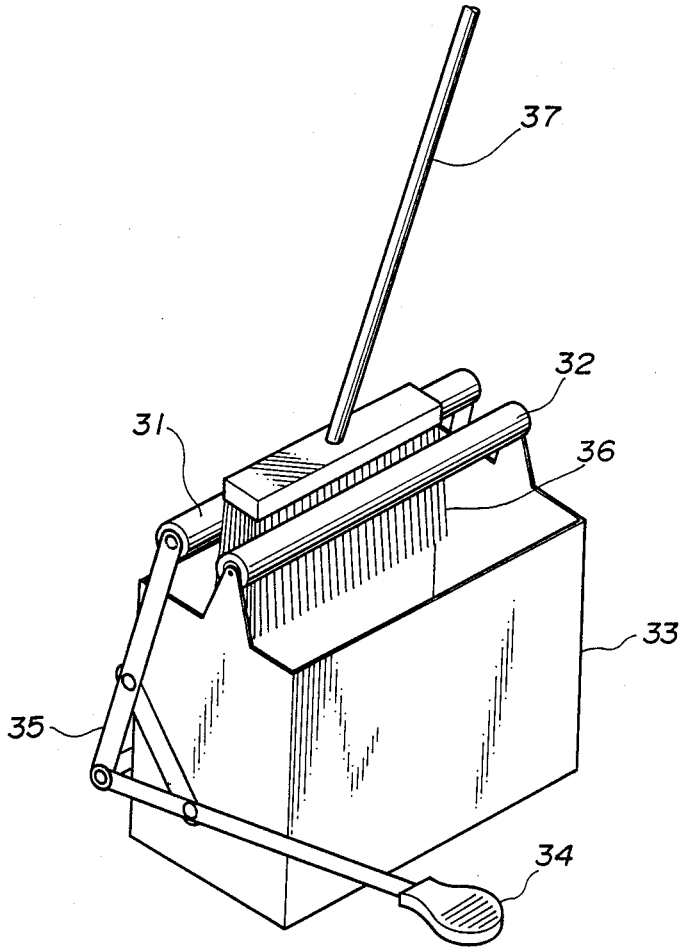
FIG. 1 PRIOR ART
FIG. 1 is a perspective view of a conventional mop squeezer with a mop under squeezing.
Figure 2:
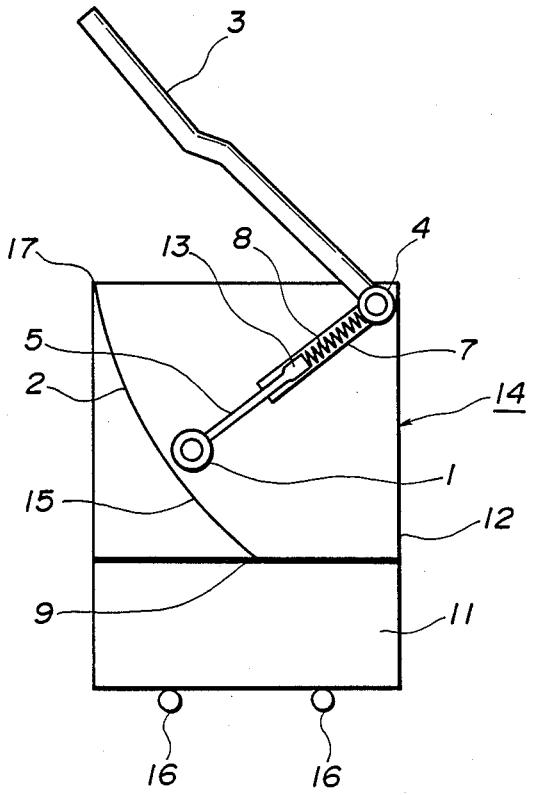
FIG. 2 is a schematic illustration of a vertical cross sectional view of the inventive mop squeezer and FIG. 3 is a perspective view of the same with a perforated squeezer plate.
Figure 3:
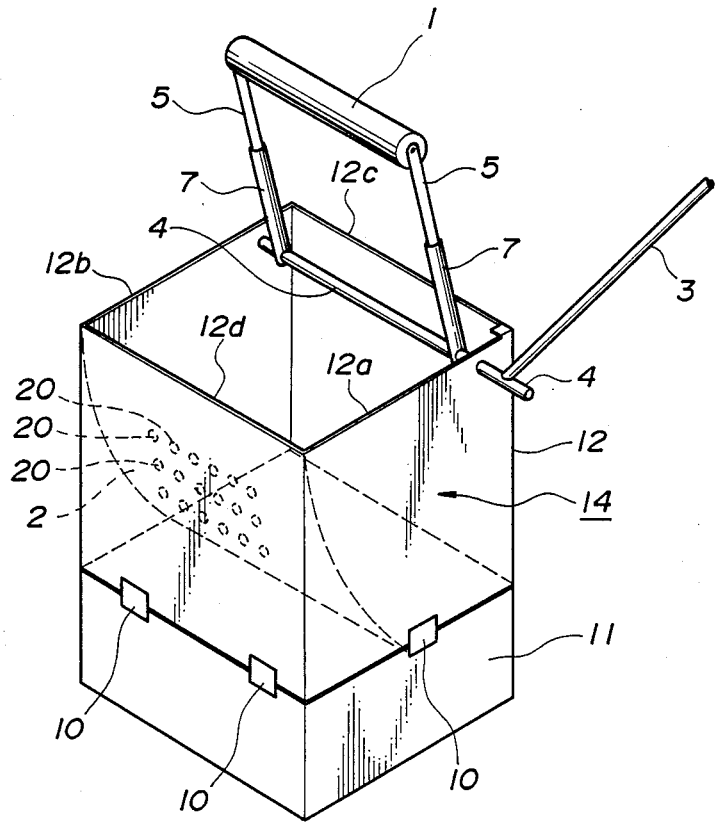

As is shown in FIGS. 2 and 3 illustrating a vertical cross sectional view and a perspective view, respectively, of a mop squeezer according to the inventive improvement, the mop squeezer is constructed of a water reservoir 11 and a squeezing part 14 connected together with a plural number of clamps 10. The water reservoir 11 can be detached from the squeezing part 14 by loosening the clamps 10 in order to facilitate discarding water in the water reservoir 11 as squeezed out from wet mop yarns.

The body of the squeezing part 14 is in the form of an upwardly opening box or frame 12 having a rectangular plan view. The mechanism for the movable roller 1 is supported by this box-like body 12. Namely, a horizontal shaft 4 is pivotally supported between the oppositely facing side panel members 12*a*, 12*b* of the box 12 at a height near to the upper end of the panel members 12*a*, 12*b*, preferably, perpendicularly thereto in the vicinity of the other side panel member 12*c*. A pair of parallel arms 5,5 are fixed to the horizontal shaft 4 at positions inside the box 12 so that rotation of the shaft 4 causes swinging of the arms 5,5 in and out of the box 12. A hand lever 3 is fixed to the shaft 4 at an extended position out of the box 12 and the arms, 5,5 are swung around the shaft 4 back and forth by pulling and pushing the hand lever 3 by hand. The direction of the hand lever 3 and the direction of the swingable arms 5,5 should preferably make an angle to facilitate movement of the hand on the lever 3 for smooth swinging of the arms 5,5. The free ends of the swingable arms 5,5 support a roller 1 which is freely rotatable around its axis parallel to the shaft 4. Thus, the movement of the roller 1 by the swinging motion of the arms 5,5 is along a cylindrical path with the shaft 4 as the axis.

Facing the cylindrical path generated by the movement of the movable roller 1 around the shaft 4, a smoothly curved squeezer plate 2 made of, for example, stainless steel is installed inside the box 12. The upper end of the squeezer plate 2 coincides approximately with the upper end of the side panel member 12*d* of the box 12 opposite to the panel member 12*c* of which the upper end runs in parallel with and closely to the shaft 4. The curved squeezer plate 2 and the box 12 are firmly conjoined together, preferably, by welding so as to be able to withstand the squeezing pressure when mop yarns are squeezed between the squeezer plate 2 and the moving roller 1.

The most characteristic feature of the mop squeezer according to the invention consists in the curvature of the squeezer plate 2. Although the surface of the squeezer plate 2 is approximately cylindrical with the shaft 4 as its axis, it is not exactly so. Namely, the distance between the shaft 4 and the horizontally running generating line of the squeezer plate 2 is not uniform but different from position to position. It is essential in the invention that the distance between the shaft 4 and the generating line of the squeezer plate 2 is smallest at the center position along the longitudinal length of the squeezer plate 2 or below and the distance increases therefrom monotonously toward the upper end 17 of the squeezer plate 2. The horizontal generating line 15 of the squeezer plate 2 at the smallest distance from the shaft 4 is referred to as the proximate line hereinbelow. The distance between the shaft 4 and the generating line of the squeezer plate 2 may be either uniform or increased downwardly from the proximate line 15. Extensive experimental investigations for the optimum distribution profile of the distance between the shaft 4 and the generating line of the squeezer plate 2 led to a conclusion that the best result of mop squeezing can be obtained when the distances between the shaft 4 and the upper end 17 of the squeezer plate 2 and between the shaft 4 and the lower end 9 of the squeezer plate 2 are in the ranges from 105% to 140% and from 100% to 110% respectively, based on the smallest distance, viz. the distance between the shaft 4 and the proximate line 15. In a typical example of the mop squeezer according to the invention, the proximate line 15 is at about the one-fourth height of the squeezer plate 2 from the lower end 9 thereof and the distances of the upper end 17 and lower end 9 from the shaft 4 are about 115% and 105%, respectively, of the smallest distance.

It is optional but preferable that the squeezer plate 2, which should be made of a rust-free material such as stainless steel and plastics, is provided with a plurality of drain perforations 20 so as to control falling of the water squeezed out of the mop yarns into the water reservoir 11 below the squeezer plate 2. The water reservoir 11 is in the form of a rectangular box to fit the lower end of the box 12 of the squeezing part 14 and can be detached from the squeezing part 14 by loosening the clamps 10 to facilitate discarding of the water therein. Though not essential, a plurality of casters 16 are provided on the lower surface of the water reservoir 11 to facilitate moving of the mop squeezer as a whole or the water reservoir 11 alone.

When the mop squeezer according to the invention is used, the swingable arms 5,5 are first swung up as is shown in FIG. 3 by pulling or pushing the hand lever 3 by hand and a mop is put down into the box 12 to rinse the mop yarns in the water pool contained in the water reservoir 11 below. Then, the rinsed mop yarns are pulled up and laid on the squeezer plate 2 at an appropriate height. Pushing or pulling of the hand lever 3 causes swinging of the swingable arms 5,5 downwardly so that the movable roller 1 is pressed against the wet mop yarns and rolls thereon to squeeze the mop yarns from the root portions to the free ends by the downward movement of the roller 1. The water squeezed out of the wet mop yarns falls into the water reservoir 11 partly through the drain perforations 20 in the squeezer plate 2 and partly after flowing along the inclined squeezer plate 2.

Figure 4:
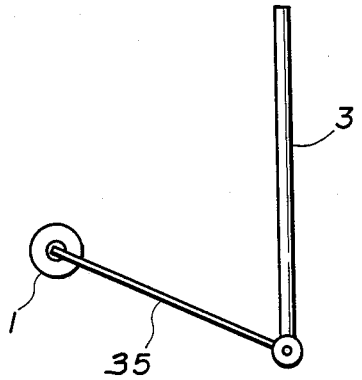
FIGS. 4 and 5 each illustrate a different structure of the swingable arm with a spring.
Figure 5:
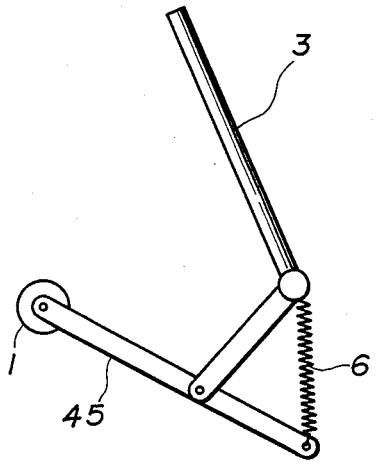

Although each of the swingable arms 5,5 as a whole can be made of a single rod, it is preferable that, as is illustrated in FIG. 2 by a cross sectional view, the arm 5 is inserted into and supported by a tubular arm base 7 in a slidable manner and thrusted toward the squeezer plate 2 by means of a coil spring 8 at the butt end 13 of the arm 5 built in the tubular arm base 7. The movable roller 1 is accordingly pressed against the squeezer plate 2 by this spring means. The mechanism of the spring means is not limited to the above mentioned coil spring 8 built in the tubular arm base 7 and various modifications are possible therefor including the use of a leaf spring 35 illustrated in FIG. 4 in place of the arm 5 in FIG. 2 and the use of a link 45 with a tensioning spring 6 illustrated in FIG. 5.

When the swingable arm 5 is provided with a thrusting spring means as is illustrated in FIG. 2, the thrusting force by which the movable roller 1 is pressed against the squeezer plate 2 naturally depends on the position of the roller 1 on the squeezer plate 2 or on the distance between the shaft 4 and the generating line of the squeezer plate 2 where the movable roller 1 is positioned. Namely, the thrusting force is largest when the movable roller 1 is at the proximate line 15 where the distance from the shaft 4 is smallest and the thrusting force is smallest when the movable roller 1 is at the upper end 17 of the squeezer plate 2 where the distance is largest. As a consequence of the varied thrusting force on the movable roller 1, the mop yarns between the roller 1 and the squeezer plate 2 are squeezed with varied strength increasing from the root portions to be squeezed loosely to the free end portions to be squeezed tightly resulting in a non-uniform distribution of the water content in the mop yarns which is higher in the root portions than in the free end portions. Such a non-uniform distribution of the water content in the mop yarns is advantageous from the standpoint of increasing the working efficiency of mopping because the water content of the mop yarns in the free end portions, from which water has been lost by transfer to the mopped floor, can be kept approporiate by the supply of water moving from the root portions of the mop yarns squeezed only loosely to ensure smooth moving of the mop yarns on the floor otherwise disturbed by the loss of lubrication with water.

The above mentioned advantage by the non-uniform water content in the mop yarns after squeezing could be established by experiments making comparison with a conventional mop squeezer in which the squeezer plate is cylindrical having a uniform distance from the shaft allover the surface. For example, a mop rinsed and squeezed in the inventive mop squeezer could be used for mopping of a linoleum floor over an area of 140 $m^2$ before the next rinse and squeezing while the area with a mop squeezed in the above mentioned conventional mop squeezer was only 20 $m^2$. When the flooring material was more water-absorbing than linoleum, the mopped areas were 100 $m^2$ and 15 $m^2$ with the mops squeezed in the inventive and conventional mop squeezers, respectively. These results support the conclusion that the working efficiency of mopping is greatly influenced by the water content or distribution thereof in the mop yarns after squeezing.

When the squeezer plate 2 is provided with no drain perforations 20, the downward movement of the movable roller 1 causes a flow of the water contained in the mop yarns toward the free end portions thereof only through the bundles of the fibers forming the mop yarns. The resistance of such compacted bundles of fibers against water flow is much larger than expected so that the free end portions of the mop yarns may contain a large volume of water unless the squeezing pressure of the movable roller 1 is quite large. The thrusting spring means 8 built in the tubular arm base 7 is usually insufficiently strong for producing such a large squeezing pressure to leave an unduly large volume of water in the free end portions of mop yarns. Mopping with unduly drenched mop yarns may cause flooding of water over the mopped floor, especially, at the start of using such a mop. When the water content of the mop yarns as a whole is too low by tightly squeezing to avoid flooding of water over the floor, the area of the floor mopped with such a mop before next rinse and squeezing is greatly decreased due to early loss of water to disturb smooth movement of the mop yarns on the floor. When the squeezer plate 2 is provided with the drain perforations 20, on the contrary, the water squeezed out of the mop yarns can easily be drained laterally through the perforations 20 to fall into the water reservoir 11 below so that the water content of the mop yarns after squeezing cannot be unduly high in the free end portions of the mop yarns and the distribution of water content throughout the mop yarns can be controlled always moderately.

Although the above described consideration may lead to a conclusion that the water content in the free end portions of the mop yarns should be as small as possible from the standpoint of increasing the working efficiency of mopping, the actual situation is more complicated. For example, the mop yarns are sometimes frayed at the very end portions thereof so that the voluminosity of the bundles of mop yarns is increased toward the ends. This is the reason for the preferred design of the mop squeezer according to the invention that the distance between the shaft 4 and the lower end 9 of the squeezer plate 2 is somewhat larger than the smallest distance between the shaft 4 and the squeezer plate 2 at the proximate line 15 or, typically the former distance is 105% of the smallest distance.

The design of the mop squeezer according to the invention should be made with some modifications depending on the size, form, material and other factors of the mops to be squeezed therein. The parameters to be modified include dimensions of the box 14, length and spring constant of the coil spring 8 for thrusting the swingable arm 5, dimensions of the squeezer plate 2 and mounting angle thereof, diameter and number of the drain perforations 20 of the squeezer plate 2 and so on. In particular, the curvature of the squeezer plate 2 and the height of the proximate line 15 are important parameters in order to attain appropriate squeezing of mop yarns.

As is mentioned before, the water reservoir 11 can be detached from the squeezing part 14 by loosening the clamps 10 to facilitate discarding the water contained therein. Along with this separate handling of the water reservoir 11 alone, the squeezing part 14 alone can be used for the purpose of mop squeezing. For example, the squeezing part 14 alone is mounted on and fixed to a washtub in a water closet by a suitable clamping means so as to utilize the washtub in place of the water reservoir 11. Advantageously, most of the washtubs installed in the water closets of buildings have a standardized size so that a squeezing part 14 according to the invention and provided with such a clamping means to fit a washtub can be used in any buildings.

It is of course optional that the water reservoir 11 and the squeezing part 14 are integrated into a single boxlike body so that construction of the inventive mop squeezer can be somewhat simplified.

In respect of the position on the shaft 4 at which the hand lever 3 is fixed to the shaft 4, it is optional to fix the hand lever 3 to the shaft 4 at a point between the two swingable arms 5,5 although FIG. 3 illustrates a hand lever 3 fixed to the shaft 4 at a position on the extension of the shaft 4 outside the box 12. It is further optional to provide two hand levers on both sides of the box 12. It is also convenient that the hand lever is connected to the shaft 4 by use of a ratchet to facilitate adjustment of the angle made by the direction of the hand lever 3 and the direction of the swingable arms 5,5. Such a mechanism is advantageous in respect of packaging and putting away of the mop squeezer with the hand lever 3 and the swingable arms 5,5 directed in the same direction. When the mop squeezer is put to use, the swingable arms 5,5 are swung down to pinch the mop yarns between the movable roller 1 and the squeezer plate 2, the hand lever 3 is turned in the slipping direction and then it is turned in the squeezing direction to cause rotation of the shaft 4. Squeezing of mop yarns can be performed by turning the hand lever 3 back and forth always at about the same position by repeating the above mentioned slipping turn and squeezing turn.

When the swingable arm 5 is provided with the thrusting spring means 8, the arm 5 has a butt end 13 which is engaged with the constricted end of the tubular arm base 7 to limit the thrusting stroke of the spring 8 so that the arm 5 is prevented from coming out of the tubular arm base 7 even when the swingable arms 5,5 are swung up above the upper end 17 of the squeezer plate 2. Various modifications are possible within the scope of the invention for the spring means to press the movable roller 1 against the squeezer plate 2 and the means to prevent the arm 5 from coming out of the tubular arm base 7.

Although the above described embodiment of the mop squeezer according to the invention has only one movable roller for squeezing, it is optional to provide two or more rollers at the ends of the swingable arms. For example, the end portion of each of the arms can be bifurcated so as to support two rollers in parallel in a freely rotatable manner. In this case, the diameters of the two rollers need not be the same but can be different from each other, one being larger than the other.

What is claimed is:

1. A mop squeezer comprising a freely rotatable movable roller held at the ends of a pair of swingable arms fixed to a horizontal shaft pivotally supported in the upper part of an upwardly opening box and rotatable by means of a hand lever fixed to the shaft, and a squeezer plate having a curved surface provided with a plurality of drain perforations, said surface being formed by the movement of a generating line in parallel with the shaft, said squeezer plate being fixed inside the box to face the movable roller with the distance between the surface of the squeezer plate and the shaft being smallest at the half length or below along the curved surface of the squeezer plate, wherein the distances between the upper end of the squeezer plate and the shaft and between the lower end of the squeezer plate and the shaft are in the range of from 105% to 140% and in the range of from 100% to 110%, respectively, based on the smallest distance between the squeezer plate and the shaft, and wherein a thrusting means is coupled to each of the pair of swingable arms for compression between said pair of swingable arms and a mop positioned on the squeezer plate to press said mop against the squeezer plate.

* * * * *